US009233275B2

(12) United States Patent
Gatherer

(10) Patent No.: US 9,233,275 B2
(45) Date of Patent: Jan. 12, 2016

(54) MUSCLE CONDITIONING /MUSCLE ASSESSMENT APPARATUS, SYSTEMS, METHODS AND/OR COMPUTER SOFTWARE

(76) Inventor: Donald Gatherer, Aylesbury (GB)

( * ) Notice: Subject to any disclaimer, the term of this patent is extended or adjusted under 35 U.S.C. 154(b) by 222 days.

(21) Appl. No.: 13/880,679

(22) PCT Filed: Oct. 20, 2011

(86) PCT No.: PCT/GB2011/052037

§ 371 (c)(1),
(2), (4) Date: Jul. 8, 2013

(87) PCT Pub. No.: WO2012/052769

PCT Pub. Date: Apr. 26, 2012

(65) Prior Publication Data

US 2013/0281261 A1 Oct. 24, 2013

(30) Foreign Application Priority Data

Oct. 20, 2010 (GB) ..... 1017687.3

(51) Int. Cl.

*A63B 71/00* (2006.01)
*A63B 24/00* (2006.01)
*A63B 21/00* (2006.01)
(Continued)

(52) U.S. Cl.

CPC ..... *A63B 24/0062* (2013.01); *A63B 21/00043* (2013.01); *A63B 21/1403* (2013.01); *A63B 21/1407* (2013.01); *A63B 21/1469* (2013.01); *A63B 24/0006* (2013.01); *A63B 24/0087* (2013.01); *A61H 1/0296* (2013.01); *A63B 21/0023* (2013.01); *A63B 2071/065* (2013.01); *A63B 2220/16* (2013.01); *A63B 2220/24* (2013.01); *A63B 2220/51* (2013.01); *A63B 2220/80* (2013.01); *A63B 2220/833* (2013.01);*A63B 2225/50* (2013.01); *A63B 2230/60* (2013.01)

(58) Field of Classification Search

CPC ..... A63B 24/0062; A63B 24/0006; A63B 24/0087; A63B 21/1403; A63B 21/1407; A63B 21/0023; A63B 21/1469; A63B 21/00043; A63B 2220/51; A63B 2220/80; A63B 2220/833; A63B 2220/16; A63B 2220/24
IPC ..... A63B 24/00
See application file for complete search history.

(56) References Cited

U.S. PATENT DOCUMENTS 4,456,249 A 6/1984 Calabrese
4,824,103 A 4/1989 Smidt
(Continued)

FOREIGN PATENT DOCUMENTS

GB 2314782 1/1998
WO WO 2006/038822 4/2006

*Primary Examiner* — Glenn Richman
(74) *Attorney, Agent, or Firm* — Thorpe North & Western LLP

(57) ABSTRACT

A muscle conditioning or muscle assessment apparatus comprises a load bearing component incorporating a proximal portion for engagement with at least part of a user's body, and a distal portion for securing said component to a fores applying apparatus or an operator; and a transducer located between said proximal and distal portions; said transducer being configured to derive signals representative of the tensile and/or compression forces applied to said load bearing component; wherein said apparatus further comprises means for determining one or more characteristics of position and/or displacement of said load bearing component; said apparatus being configured to output signals representative of said force and the direction of said force.

19 Claims, 10 Drawing Sheets

(51) Int. Cl.

| | |
|---|---|
| *A61H 1/02* | (2006.01) |
| *A63B 21/002* | (2006.01) |
| *A63B 71/06* | (2006.01) |

(56) References Cited

U.S. PATENT DOCUMENTS

| | | | | |
|---|---|---|---|---|
| 5,391,080 | A * | 2/1995 | Bernacki et al. | 434/254 |
| 5,538,486 | A | 7/1996 | France et al. | |
| 5,558,609 | A | 9/1996 | Olschansky et al. | |
| 8,079,971 | B2 * | 12/2011 | Becerra | 602/32 |
| 8,663,133 | B2 * | 3/2014 | Johnson et al. | 601/23 |
| 2003/0153438 | A1 * | 8/2003 | Gordon et al. | 482/92 |
| 2006/0229167 | A1 * | 10/2006 | Kram et al. | 482/54 |
| 2008/0119763 | A1 | 5/2008 | Wiener | |
| 2009/0062092 | A1 * | 3/2009 | Mortimer et al. | 482/142 |
| 2010/0125026 | A1 | 5/2010 | Zavadsky et al. | |

* cited by examiner

MUSCLE CONDITIONING /MUSCLE ASSESSMENT APPARATUS, SYSTEMS, METHODS AND/OR COMPUTER SOFTWARE

FIELD OF THE INVENTION

The invention relates to muscle conditioning or muscle assessment apparatuses. The invention also relates to systems for muscle assessment and/or conditioning. Optionally, the invention relates to a method of deriving a template for muscle conditioning or muscle assessment. Furthermore, the invention relates to computer software configured to operate methods according to the invention. Optionally, the invention relates to apparatuses used for methods of testing and analysis. Optionally, the invention relates to collecting and storing values in a database.

BACKGROUND TO THE INVENTION

Exercise harnesses are well known in the art. However, these often present the following drawbacks:

- If used by untrained operators a high proportion of injuries are likely to result; so harness straps can be misplaced, the forces applied can be disproportional, the level of applied force may be excessive;
- There is little or no electronic feedback indicative of the level of applied load, let alone any scope for adjustment of the applied load; and
- Prior art systems fail to provide assessments of the scientific detail required for improved analysis and rehabilitation programmes.

The invention seeks to overcome at least some of these drawbacks whilst offering solutions to further technical problems which can be deduced from the aspects and description which now follow. The invention seeks to provide solutions for muscle conditioning or muscle assessment in both tension and compression modes.

SUMMARY OF THE INVENTION

In a first broad independent aspect, the invention provides a muscle conditioning or muscle assessment apparatus comprising a load bearing component incorporating a proximal portion for engagement with at least part of a user's body, and a distal portion for securing said component to a force applying apparatus or an operator; and a transducer located between said proximal and distal portions; said transducer being configured to derive signals representative of the tensile and/or compression forces applied to said load bearing component; wherein said apparatus further comprises means for determining one or more characteristics of position and/or displacement of said load bearing component; said apparatus being configured to output signals representative of said force and the direction of said force.

In a subsidiary aspect, said load bearing component incorporates a harness for attachment to at least part of a user's body, said harness incorporating one or more straps for securing said harness to said at least part of a user's body; a distal portion for facilitating the attachment of said harness to a force applying apparatus or an operator; a transducer; one or more joining members extending between said harness and said distal portion.

In a second broad independent aspect, the invention provides a muscle conditioning or muscle assessment apparatus comprising a harness for attachment to at least part of a user's body, said harness incorporating one or more straps for securing said harness to said at least part of a user's body; a distal portion for facilitating the attachment of said harness to a force applying apparatus or an operator; a transducer; one or more joining members extending between said harness and said distal portion; wherein said transducer is configured to derive signals representative of the force applied to said joining members; and output said signals representative of said force.

This configuration is particularly advantageous since it provides improved determination of the forces in the apparatus.

In a subsidiary aspect, the transducer is part of a load cell equipped with releasable attachment means for releasably attaching said load cell to said joining members. This allows the load cell to be selectively employed and/or facilitates its replacement if necessary.

In a further subsidiary aspect, the apparatus further comprises a wireless transmitter for transmitting signals to a wireless receiver located remotely from the transmitter. This is particularly advantageous in order to allow an operator to apply the necessary force and to control the applied force by following indications obtained from a wireless receiver, it also avoids the restrictions imposed by a wire which could interfere with the correct operation of the apparatus.

In a further subsidiary aspect, the apparatus further comprises a housing containing said transducer; said housing being part metallic and part polymeric. Said polymeric portion being optionally in the form of a window through which wireless communication signals are transmitted. Said polymeric portion may also be in the form of a sleeve for containing at least in part the metallic part. This is part. This is particularly advantageous in order to protect the sensitive electronic components contained in the housing whilst allowing sufficient interference-free communication to take place through the wall of the housing.

In a further subsidiary aspect, the apparatus further comprises a three-dimensional position sensor which determines the position of said joining members. This allows the processor to more rapidly determine the motion or the direction of the force applied in order to derive accurate values which correlate precisely to a particular motion type.

In a further subsidiary aspect, the apparatus further comprises a gyroscope or an angular rate sensor for determining one or more characteristics of position and/or displacement of said joining members. This option is particularly advantageous in order to apply position control for the apparatus or operator. This would be particularly useful in reducing the level of skill required by an operator.

In a further subsidiary aspect, the apparatus further comprises a position sensor selected from the group comprising capacitive, inductive, magnetic, and piezoelectric.

In a further subsidiary aspect, said harness incorporates a first portion projecting, in use, from a first side of said body part and a second portion, projecting, in use, from a second side of said body part; joining members being provided between said first portion and said distal portion; and between said second portion and said distal portion; and means for equalising tensioning forces applied on said first and second portions. This configuration is particularly advantageous in order to reduce the likelihood of injuries to a subject during his/her interaction with the apparatus.

In a further subsidiary aspect, said means for equalising tensioning forces incorporate a pulley. The provision of a pulley is particularly advantageous since it involves very few components allowing the arrangement to be advantageously lightweight and compact.

In a further subsidiary aspect, said distal portion incorporates a handle. This configuration is particularly advantageous in order to allow an operator and/or a three-dimensional driving arm to be attached securely to the apparatus.

In a further subsidiary aspect, said transducer is provided between said handle and said means for equalising tensioning forces. This provides an advantageous determination of the tensioning forces whilst combining the advantageous equalised distribution of forces presented in the previous aspects.

In a further subsidiary aspect, said proximal portion incorporates a pressure plate.

In a further subsidiary aspect, said pressure plate is concave.

In a third broad independent aspect, the invention provides a system for muscle assessment and/or conditioning comprising an apparatus according to any of the preceding aspects, a processor and a display unit located remotely from said transducer for displaying the variation over time of the measured load for a given type of muscular motion of a particular muscle or muscle group. This configuration may be particularly advantageous when the display is in the form of a curve of the variation of load in kilograms relative to the lapsed time. It allows the derivation of the integral of the curve.

In a further subsidiary aspect, said apparatus is configured to or is employed to steadily increase the applied load up to the particular muscle or muscle group's maximum. This is particularly advantageous in order to determine the maximum values and any endurance level values and rehabilitation values which may be obtained from the determination of the maximum values.

In a further subsidiary aspect, said processor is configured to determine the motion for which characteristics are being measured; said motions being selected from the group comprising: flexion, extension, adduction, abduction, protraction, retraction and rotation. This further improves the interaction with a user who may have limited knowledge of the motion types whilst still allowing the assessment to take place.

In a further subsidiary aspect, said processor is configured to determine the direction of the motion; said motion being selected from the group comprising: right, left, forwards, backwards, upwards and downwards. This configuration is particularly advantageous when the apparatus is driven by a mechanical arm configured for example to drive the various motion types and/or load conditions.

In a further subsidiary aspect, said processor is configured to determine the direction of the motion in any direction in the X, Y and Z coordinate system.

In a further subsidiary aspect, said processor is configured to determine a value representative of the deficit between maximum flexion and corresponding maximum extension for a particular muscle or muscle group. This allows the determination of areas which diverge from predetermined norms so that the apparatus may determine which corrective rehabilitation test is most appropriate.

In a further subsidiary aspect, said processor is configured to determine a value representative of the deficit between opposite actions.

In a further subsidiary aspect, said processor is configured to determine a value representative of the deficit between contra-lateral actions.

The processor may be configured to determine a value representative of for example left/right biceps or for example agonist and/or antagonist.

The processor may be configured for any of unilateral/contra-lateral testing/bilateral testing.

In a further subsidiary aspect, said processor and said display unit are configured to display a template comprising a plurality of sections; each section specifying a motion type and having a predetermined load characteristic for a predetermined time. This configuration is particularly advantageous since it can act as a guide for either the apparatus or an operator in order to achieve a varied rehabilitation programme.

In a further subsidiary aspect, said processor and display unit are configured to display the measured load characteristic. Said measured load characteristic being displayed over said template. This allows the apparatus and/or operator to apply corrective measures if necessary in order to achieve a particularly desired load level.

In a fourth broad independent aspect, the invention provides a method of deriving a template for muscle conditioning or muscle assessment comprising the steps of:

- Determining the maximum load withstood for a given motion;
- Calculating a predetermined proportion of said maximum load level to determine an endurance load level;
- Applying a load at said determined endurance load level up to muscular fatigue;
- Recording the evolution of the measured load level relative to elapsed time;
- Deriving a value corresponding to the area underneath the measured load level curve;
- Deriving a template with a plurality of sections; each section specifying a motion type and having a predetermined load characteristic for a predetermined time; and
- Equating the area underneath the template to the area underneath the measured endurance load level curve.

This configuration provides particularly advantageous programmes for muscular conditioning and/or rehabilitation. The derivation of the template is scalable for a wide variety of individuals with disparate initial conditioning and characteristics.

In a further subsidiary aspect, the method comprises the step of selecting said motion type from the group comprising: isometric actions, concentric actions, eccentric actions, hold, hold left, hold right, rotate, hit central, sweep left, and sweep right. This sequence and potential combination of motions is particularly advantageous in order to optimise further the rehabilitation levels achieved by following a template of this kind.

In a further subsidiary aspect, said method incorporates a sequence of hold in a first direction, rotate, and hold in a second direction. This further improves the level of muscular conditioning and rehabilitation.

In a further subsidiary aspect, said method incorporates a sequence of rotate, hold in a direction and rotate.

In a further subsidiary aspect, said method incorporates a sequence of rotate, hit central and sweep in a first direction and a second direction.

In a further subsidiary aspect, said method incorporates a sequence of hold, hold in a first direction, rotate, hold in a second direction, rotate, hit central, sweep in a first direction and a second direction, and hold. This sequence is disproportionately beneficial when assessed against other sequences derived in accordance with the invention.

In a further subsidiary aspect, said template has a mean load level which is a proportion of a maximum test level.

In a further subsidiary aspect, said proportion is selected within the range of 20% to 70% lower than said maximum test level.

In a further subsidiary aspect, said proportion is selected to be 75% lower than said maximum test level.

In a further subsidiary aspect, said method further comprises the step of indicating when the recorded load level curve area is within a predetermined percentage of a maximum value.

In a fifth broad independent aspect, the invention provides a computer software configured to operate the method of any of the appropriate preceding aspects.

In a sixth broad independent aspect, the invention provides a muscle conditioning or muscle assessment apparatus comprising a harness for attachment to at least part of a user's body, said harness incorporating one or more straps for securing said harness to at least part of a user's body; an attachment for facilitating the attachment of said harness to a force applying apparatus or operator; a transducer; one or more joining members extending between said harness and said attachment; wherein said transducer is configured to derive a signal representative of the force applied to said joining members; and output a signal representative of said force; wherein said apparatus further comprises a processor and a display unit for displaying the variation over time of the measured load for a given motion of a particular muscle or muscle group; said processor and said display being configured to display a template comprising a succession of distinct sections; each section specifying a motion type having a predetermined load characteristic for a predetermined time.

In a further subsidiary aspect, said processor and display unit are configured to display the measured load characteristic; said measured load characteristic being displayed over said template.

In a further subsidiary aspect, said template incorporates distinct sections corresponding to distinct motion types selected from the group comprising: hold, hold left, hold right, rotate, hit central sweep left, and sweep right.

In a further subsidiary aspect, said template incorporates a sequence of hold in a first direction, rotate, and hold in a second direction.

In a further subsidiary aspect, said template incorporates a sequence of rotate, hold in a direction and rotate.

In a further subsidiary aspect, said template incorporates a sequence of rotate, hit central and sweep in a first direction and a second direction.

In a further subsidiary aspect, said template incorporates a sequence of hold, hold in a first direction, rotate, hold in a second direction, rotate, hit central, sweep in a first direction and a second direction, and hold.

DETAILED DESCRIPTION OF THE FIGURES

Figure 1:
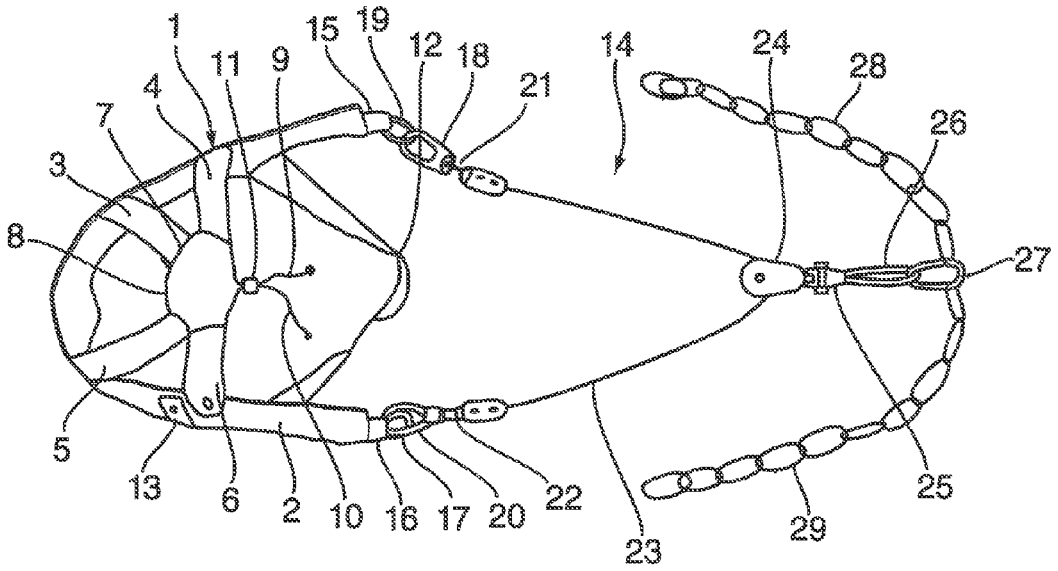
FIG. 1 shows a plan view of an apparatus in a first embodiment of the invention.

FIG. 1 shows a harness 1 which may be used for exercises, conditioning, assessments and/or rehabilitation. The harness may take a variety of forms suitable for attachment to specific body parts of a subject. The particular configuration of harness shown in FIG. 1 is sized and shaped to allow at least part of the head of a subject to fit within the harness. Harness 1 incorporates a primary band or strap 2 which is substantially C-shaped when viewed in plan. The strap 2 may extend in use, when fitted on the head of a subject, around at least part of the circumference of the subject's head. Strap 2 would for example, in use, be positioned above the ears of a subject and extend substantially horizontally or at eye level. Projecting inwardly from the strap 2, there are provided a plurality of substantially radially extending secondary straps 3, 4, 5 and 6. Each individual said strap may be pivotally attached to primary strap 2. Straps 3, 4, 5 and 6 are provided to extend across the upper part of the subject's cranium. At their distal extremities, such as extremity 7, each strap employs a tunnel through which a rope, string or strap 8 is threaded. The extremities 9 and 10 of the attaching string are held together by a clasp or bead 11. Bead 11 may frictionally grip or clamp on to the strings which are held in the bead. A further form of strap is provided as strap 12 and is sized and configured to act as a chin strap. At its extremities the chin strap 12 may also be pivotally mounted to the primary strap 2. A rivet 13 or like attachment means may be provided in order to achieve the necessary relative rotation.

The various straps of the harness may be equipped with releasable attachment means between interconnected portions of straps. These may take the form of press-stud fasteners. These may also take the form of filamentary touch-to-close systems which are often referred to as VELCRO fasteners (VELCRO is a registered trade mark). The releasable attachment may preferably have an audible release in order to warn of a particular hazard.

A number of linkage members generally referenced 14 are provided between the harness and a load cell (not shown in FIG. 1). At opposite extremities 15 and 16 of strap 2, rings 17 and 19 are respectively secured to karabiners 18 and 20. Karabiners 18 and 20 are also secured to loops 21 and 22 which are provided at opposite extremities of cable 23. Cable 23 is thread through pulley housing 24 and is sized and shaped to fit within the peripheral track of the pulley (not shown). In order to avoid undue twisting of the joining members, a universal joint or ball joint 25 is mounted onto the distal extremity of the pulley housing. The universal joint may have facilitate rotation relative to two axis of rotation disposed at right angles. One of these axes may be substantially longitudinal whilst the other may be normal to the longitudinal direction. A further karabiner 26 links the universal joint to a loop 27 which joins oppositely disposed chains 28 and 29.

Optionally, at least cable 23, straps 2-6 are substantially non-elastic.

Whilst a pulley 24 has been illustrated as a particularly advantageous form of means for equalising tensioning forces, other systems may be employed. These may include for example a clamp based system or a hydraulically controlled load distributor.

Figure 2:
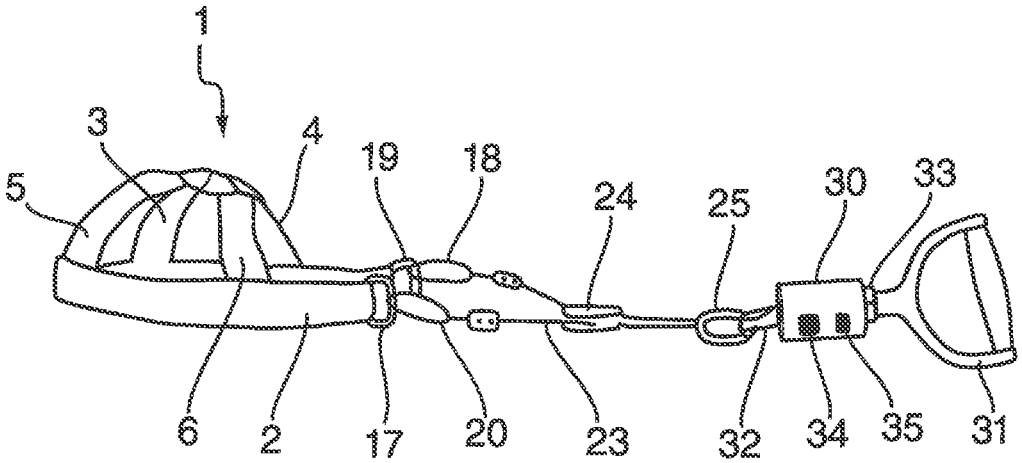
FIG. 2 shows a side view of an apparatus according to a second embodiment of the invention.

FIG. 1 is configured to allow the attachment of a load cell which determines the tension in the linkage members. FIG. 2 shows a harness, joining members, a load cell and a handle. The components of the apparatus of FIG. 2 which are common with the components of the apparatus of FIG. 1 have retained identical numerical references for clarity. Universal joint 25 is preferably directly attached to a load cell 30 which in turn is preferably directly attached to a handle 31. The attachment between load cell 30 and universal joint 25 incorporates a fastener 32 which may be a threaded projection which releasably engages with a threaded recess in the load cell 30. Similarly, a fastener 33 is provided between the load cell 30 and the handle 31 which may be released by an operator by releasing a nut or other suitable releasable fastener.

The load cell 30 incorporates a housing which is cylindrical and may be circular in cross section. The housing may primarily be formed of aluminium or stainless steel with the circuitry or sensor being fully enclosed within the housing. In order to mount the internal components of the load cell, a first openable window 34 may be provided. Furthermore, the housing may be provided with a second window to allow transmission of communication signals through the housing. This second window may be made of a suitable polymer. An on/off switch may be provided on either of the end faces of the cylindrical housing. Furthermore, a socket may be provided to engage a power cable for charging batteries or for powering the electrical components contained within housing 30.

Figure 3:
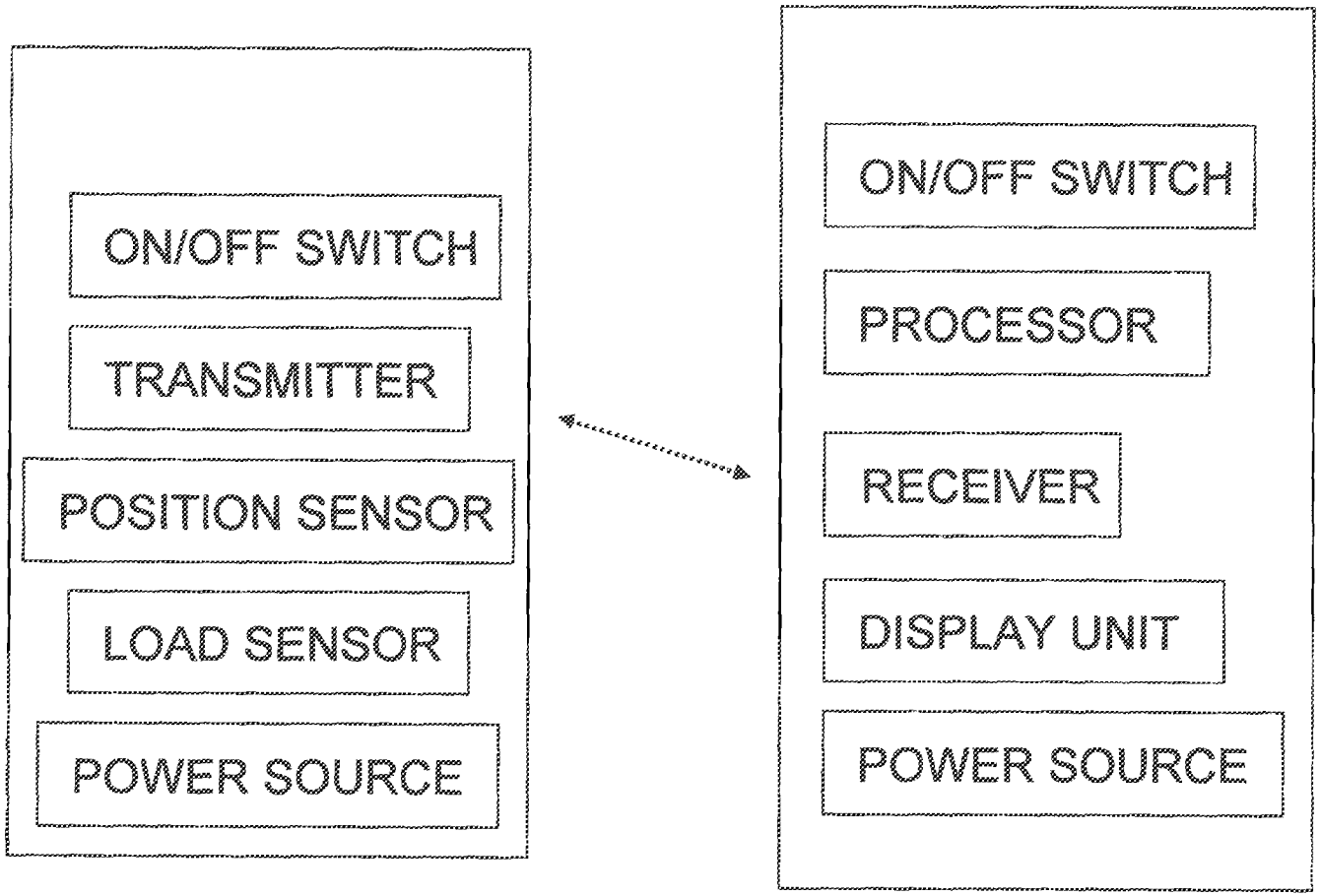
FIG. 3 shows block diagrams of a load cell wirelessly communicating with a remotely located processor and display unit.

FIG. 3 shows the primary components of the load cell in further detail. In particular, the load cell may include a load sensor which may take the form of a transducer which generates signals which are representative of the force applied across the load cell. The load sensor may incorporate a strain gauge which causes a change in voltage dependent upon the extent to which the strain gauge is stretched. The load sensor may alternatively be any one of the sensors selected from the group comprising angular rate, capacitive, inductive, magnetic, and piezoelectric. For example, by providing a piezoelectric unit which when stretched generates a variable voltage and/or current, a signal representative of the load applied on the load cell is obtained and consequently a signal representative of the tensile forces in the linkage members of the apparatus described in FIGS. 1 and 2 may be derived.

In order for the apparatus illustrated in FIGS. 1 and 2 to have its maximum effect determining the position in space of the load sensor is particularly advantageous. In order to do so, a position sensor in addition to the load sensor may be provided as part of the circuitry located within the load cell. In order to detect changes in the angular position of the load cell, it is particularly advantageous to incorporate an electronic angular rate sensor or gyroscope. Instead and/or in addition to an electronic gyroscope, the embodiment also envisages the position sensors selected from the group comprising capacitive, inductive, magnetic, and piezoelectric.

A transmitter is also envisaged in order to allow wireless communication between the load cell and a remotely positioned processing unit. By combining the muscle conditioning or muscle assessment apparatus of FIGS. 1 and 2 with the processing and displaying unit, a system for muscle assessment and/or conditioning is provided. Whilst FIG. 3 illustrates that the processor is provided as part of the receiver unit, it is also alternatively envisaged to provide the processor within the load cell or as part of a third distinct unit if necessary.

As illustrated in FIG. 3, the transmitter of the load cell is configured to transmit to a receiver in the receiving unit. However, both the load cell and the receiver unit may incorporate transmission and receiving capabilities. The load cell may for example be equipped with a receiver to facilitate the calibration of the sensors. The receiver unit would also optionally incorporate a power source, an on/off switch and a user interface. The user interface may be in the form of a touch screen which may both display data and allow the operator to select from a range of options.

Figure 4:
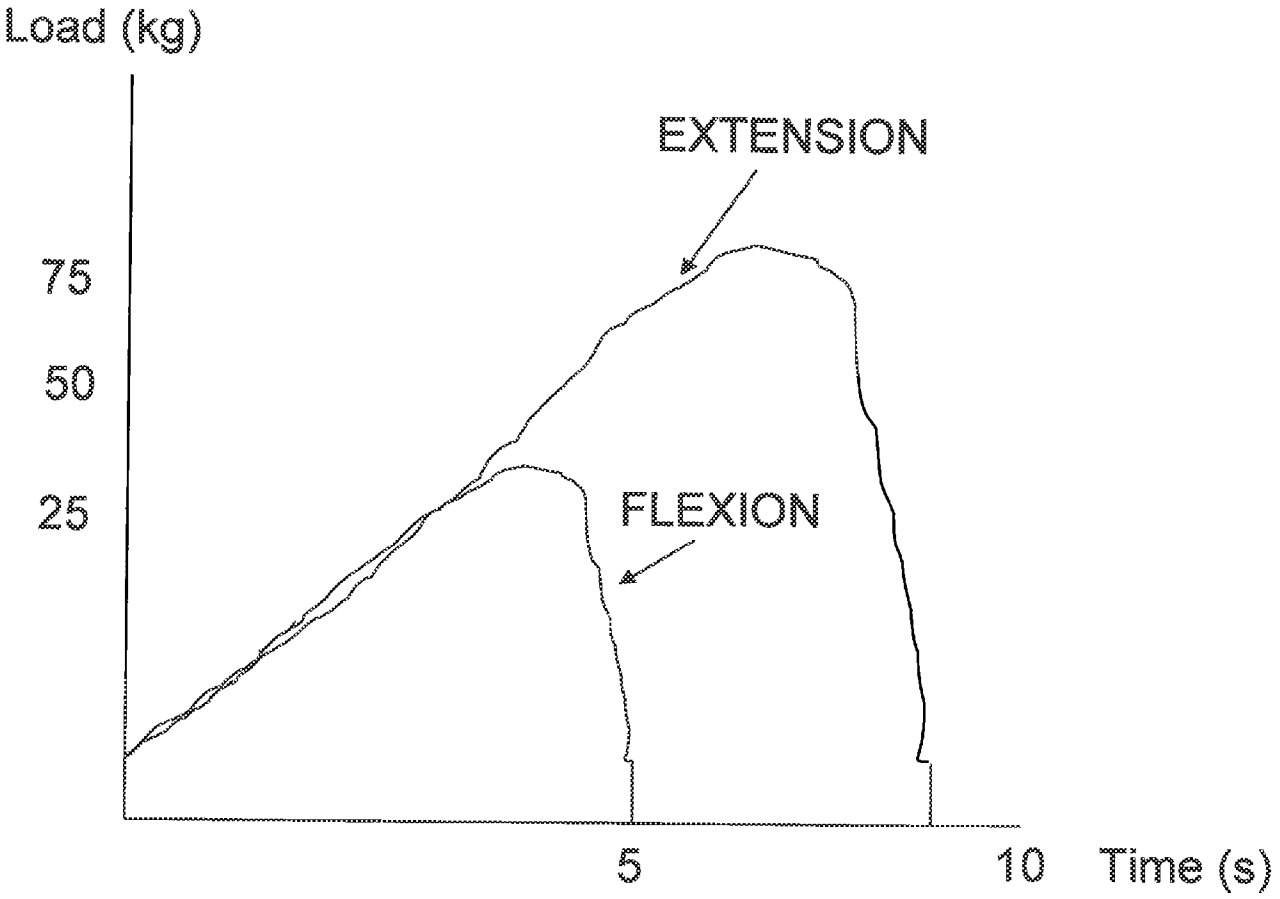
FIG. 4 illustrates the results of a maximum cervical test for extension and flexion motions.

FIG. 4 shows the potential results of measurements measured in the load cell 30 of FIG. 2, transmitted to the processor for display on a screen in a co-ordinate system with the load values provided in the Y-axis and the time in seconds provided in the X-axis. In this embodiment, a user's head was placed in the harness 1 and the harness was oriented in a first mode of motion corresponding to cervical flexion and in a second mode of motion corresponding to cervical extension. As shown in the measurements, the load steadily increases in almost linear fashion up to the maximum, at which point the load decreases rapidly. This Figure illustrates the variation over time of the measured load for a given type of muscular motion (flexion or extension) of a particular muscle or muscle group (the cervical group).

In this illustration, the maximum flexion load determined was F(max)=33.4 whilst the maximum extension value determined was Ex(max)=79.2.

These measured values allow the derivation of a flexion/extension deficit by following the formula:

$$\text{Flexion/extension deficit}=(1-(F(\max)/Ex(\max)))\times 100$$

For example: Flexion/extension deficit=(1−(33.4/79.2))×100=57%

The same basic formula may be followed to determine side flexion left and side flexion right. Once the maximum side flexion left and side flexion right values are determined, the side flexion deficit may also be derived.

In addition to the cervical test for flexion and extension further similar tests may be carried out by employing the harness configuration of FIG. 2. In particular, a cervical rotation test may be employed to determine the various maxima for distinct motions such as flexion left rotation, flexion right rotation, extension left rotation, extension right rotation. As detailed with respect to the cervical test, the cervical rotation test allows the deficit between flexion left rotation and flexion right rotation to be determined. Furthermore, the deficit between extension left rotation and extension right rotation may also be determined.

Further tests may be conducted, for example a shoulder test, an elbow test, a wrist test may also be carried out by appropriately strapping the harness of FIG. 2 around the appropriate body part to carry out the various motions.

This method allows a comprehensive and detailed assessment of particular motions of muscles and/or muscle groups.

The term "motion" is to be interpreted as including amongst others, flexion, extension, adduction, abduction, and rotation.

For the shoulder test, the motions taken into consideration include at least the following: flexion left, flexion right, extension left, extension right.

For the shoulder rotation test, the following motions may be taken into consideration: internal rotation left, internal rotation right, external rotation left, and external rotation right.

For the shoulder abduction test, the various motions taken into consideration include at least: abduction (first position) left, abduction (first position) right, abduction (second position) left and abduction (second position) right.

For the shoulder adduction test, the following motions may be taken into consideration: adduction (first position) left, adduction (first position) right, adduction (second position) left, and adduction (second position) right.

For the shoulder test of the scapular retraction/shrug, the following motions at least may be taken into consideration: scapular retraction left, scapular retraction right, shrug left, and shrug right.

For the elbow test, the following motions may be taken into consideration: flexion (first position) left, flexion (first position) right, flexion (second position) left, and flexion (second position) right.

For the elbow test of extension/wrist grip, the following motions at least may be taken into consideration: extension left and extension right.

As a further example, the motions taken into account in the wrist flexure/extension test may be the following: flexion left, flexion right, extension left, and extension right.

A further example may be obtained from a thumb extension/fifth digit (little finger) abduction test by taking into account the following motions: thumb extension left, thumb extension right, fifth abduction left, and fifth abduction right.

The following embodiment illustrates the method of deriving a template for muscle conditioning or muscle assessment. As illustrated in the previous embodiment the maximum extension endurance determined was approximately 80 kg for cervical extension. Once this value has been determined by the apparatus, the processor may be configured to calculate a predetermined proportion of the maximum load level to determine a fatigue load level. The fatigue load level may be set for example at 50% of the load reached in the maximum test of FIG. 4.

Figure 5:
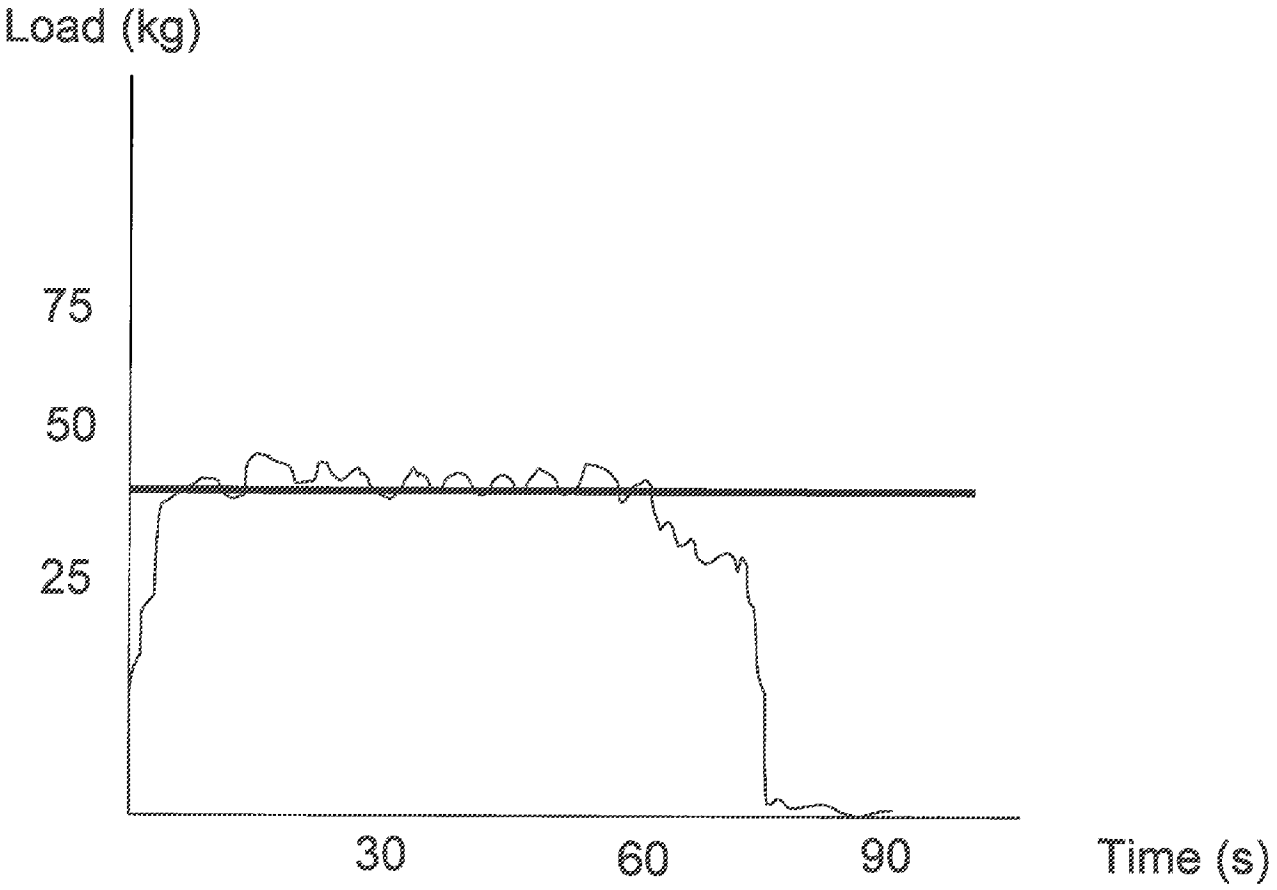
FIG. 5 shows an endurance test result.

The thick horizontal line in FIG. 5 illustrates the 50% level for performing an extension fatigue test. The apparatus or operator applies a load at said determined fatigue load level up to muscular release. The curve in FIG. 5 shows the measured load obtained from the measurements of the load cell. After approximately 80 seconds the user reaches the fatigue point and the load consequently drops off. By calculating the integral of the curve shown in FIG. 5, the area beneath the curve can be determined. This may for example be approximately 2,700 kg. Instead of simply repeating this fatigue test, a template for a rehabilitation programme is derived by the processor. The template is formed from a plurality of sections or successive sections; each section specifying a motion type and having a predetermined load characteristic for a predetermined time. The area beneath the thickened line in FIG. 6 corresponds to the area calculated by integrating the measured curve in FIG. 5. The apparatus thereafter applies a load and a motion corresponding to the various sections of the template in order to carry out a rehabilitation programme. The curve shown in close proximity to the various sections of the template corresponds to the measurements derived from the load cell as the apparatus or the operator applies the necessary force in the specified template directions.

The template is formed from a plurality of sections selected from the group comprising: hold, hold left, hold right, rotate, hit central, sweep left, and sweep right.

Figure 6:
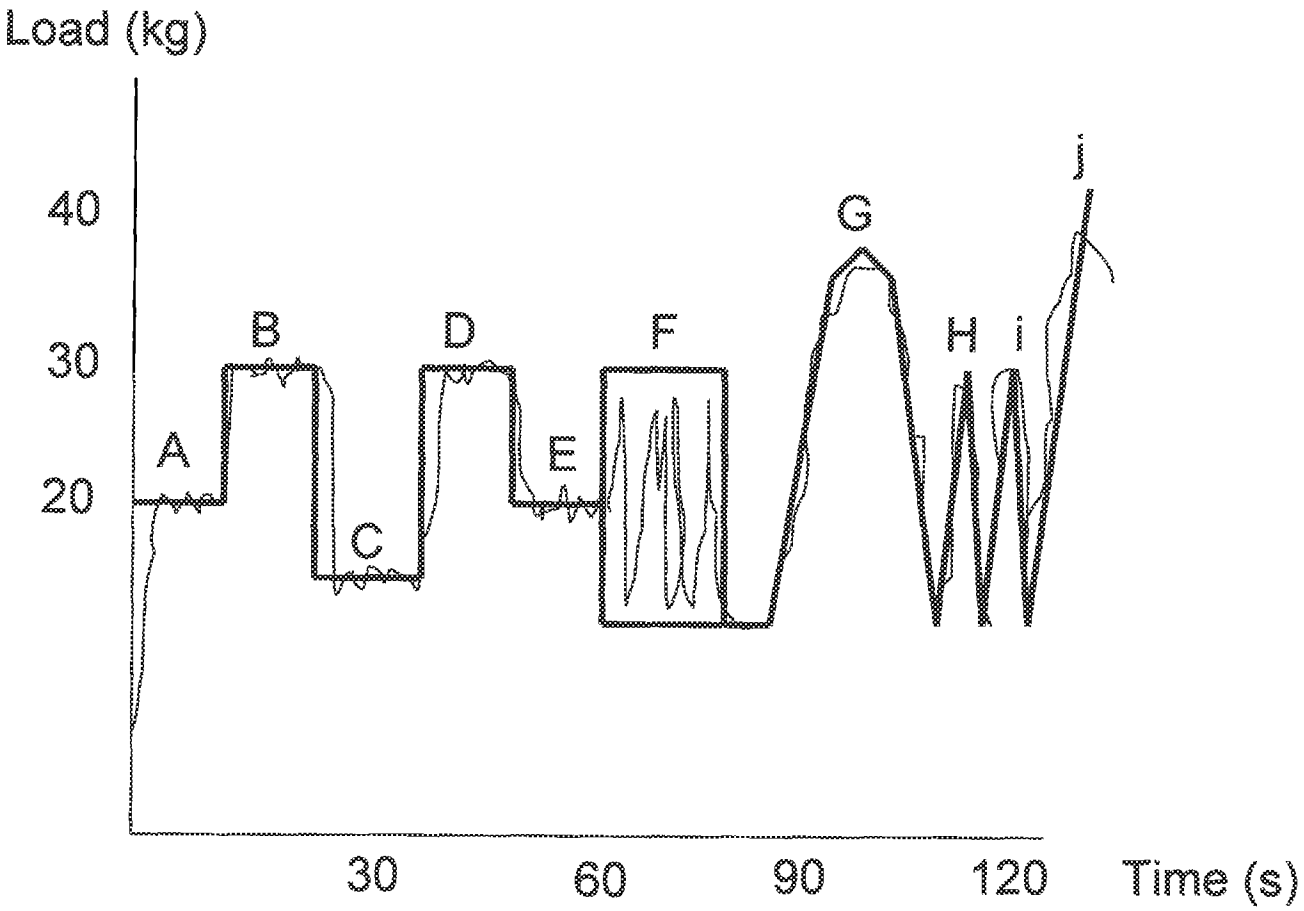
FIG. 6 shows a template in combination with the results of measured rehabilitation loads.

The various motions as employed in the template of FIG. 6 are as follows:

A=hold;
B=hold left;
C=rotate;
D=hold right;
E=rotate;
F=hit central;
G=sweep left/right;
H=hold;
I=hold;
J=max out.

Figure 7:
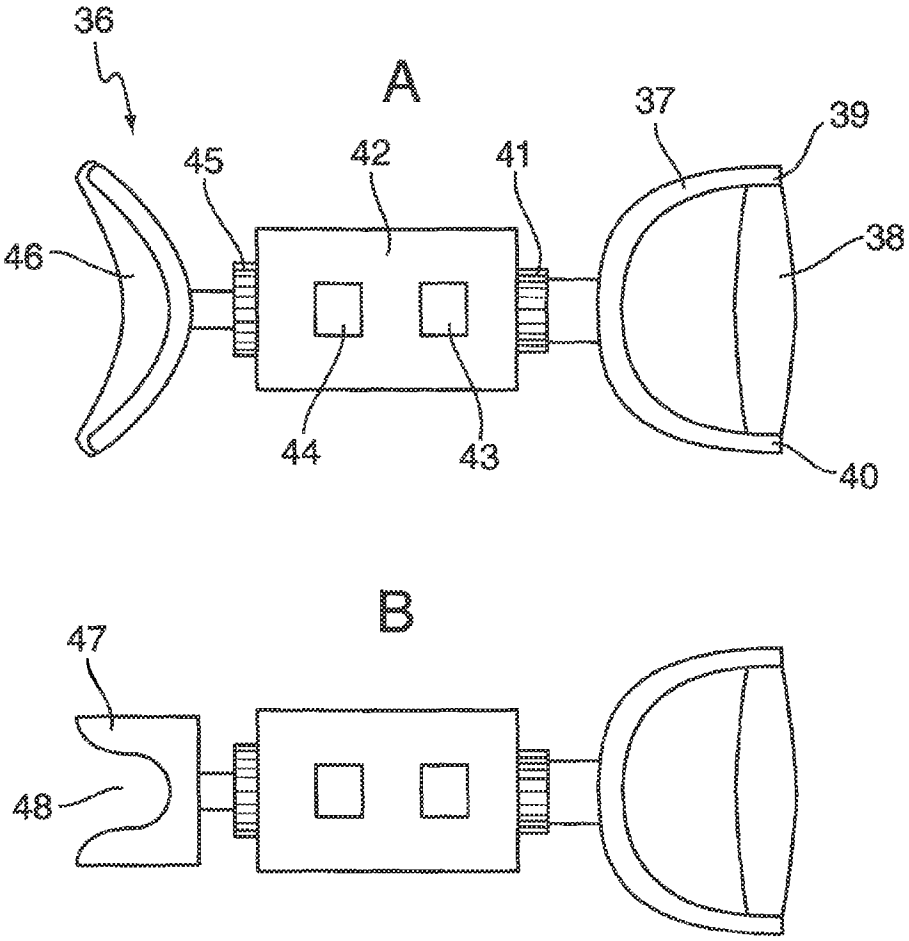
FIGS. 7A and 7B show respectively side elevations of an apparatus used in compression modes rather than tension as in the previous embodiments.

FIG. 7A shows a muscle conditioning or muscle assessment apparatus generally referenced 36. As in the previous embodiments, the apparatus incorporates a load-bearing component. However, instead of it being a harness, it is a relatively rigid structure in order to apply compression on a user. The load-bearing component incorporates a handle 37 at a distal portion for securing the component to a force applying apparatus or to the hand of the operator. The handle is C-shaped in side view with a primary hand engaging axle 38 located between extremities 39 and 40 of the C-shaped member. A releasable attachment 41 is provided between the handle and a load cell housing 42. As in previous embodiments, a number of apertures 43 and 44 are provided to either allow access to the housing and/or to allow connectivity and/or transmission with separate processing means. A further releasable attachment means 45 is provided at the proximal extremity of the load-bearing component. This releasable attachment means secures a pressure plate 46 to the load cell housing. The pressure plate may be generally flat in some embodiments. However, as shown in FIG. 7A it may be substantially C-shaped in cross section. It may be substantially concave and/or convex dependent upon the area of the body against which, in use, the pressure plate would be placed.

The apparatus of FIG. 7B is identical to the embodiment of FIG. 7A apart from the configuration of pressure plate 47. This configuration of pressure plate incorporates a block with a front recess 48 sized and shaped to engage against a particular member of the user's body.

Figure 8:
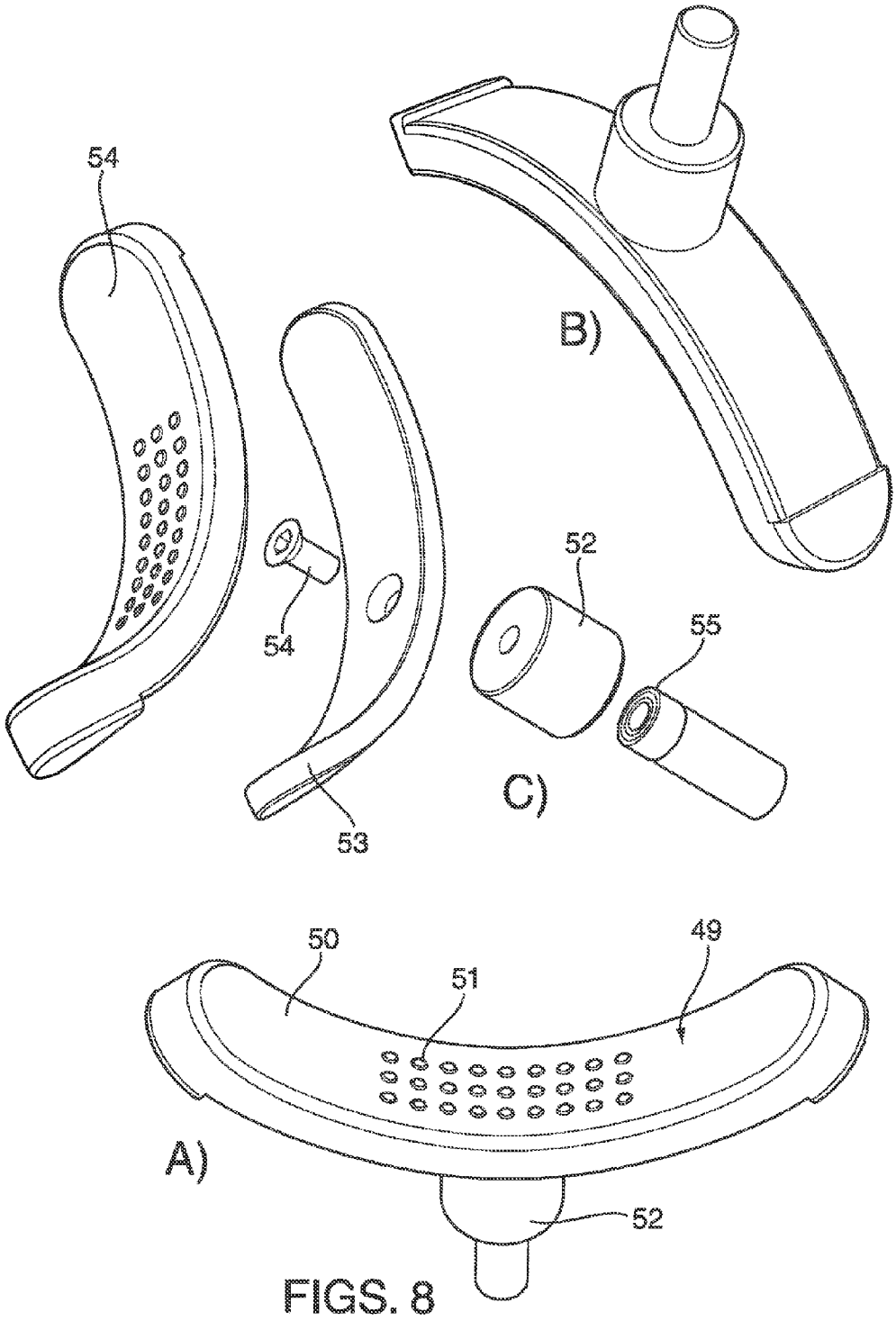
FIG. 8A shows a perspective view of a pressure plate from the top.
FIG. 8B shows a perspective view of a pressure plate from underneath.
FIG. 8C shows an exploded perspective view of a pressure plate.
Figure 9:
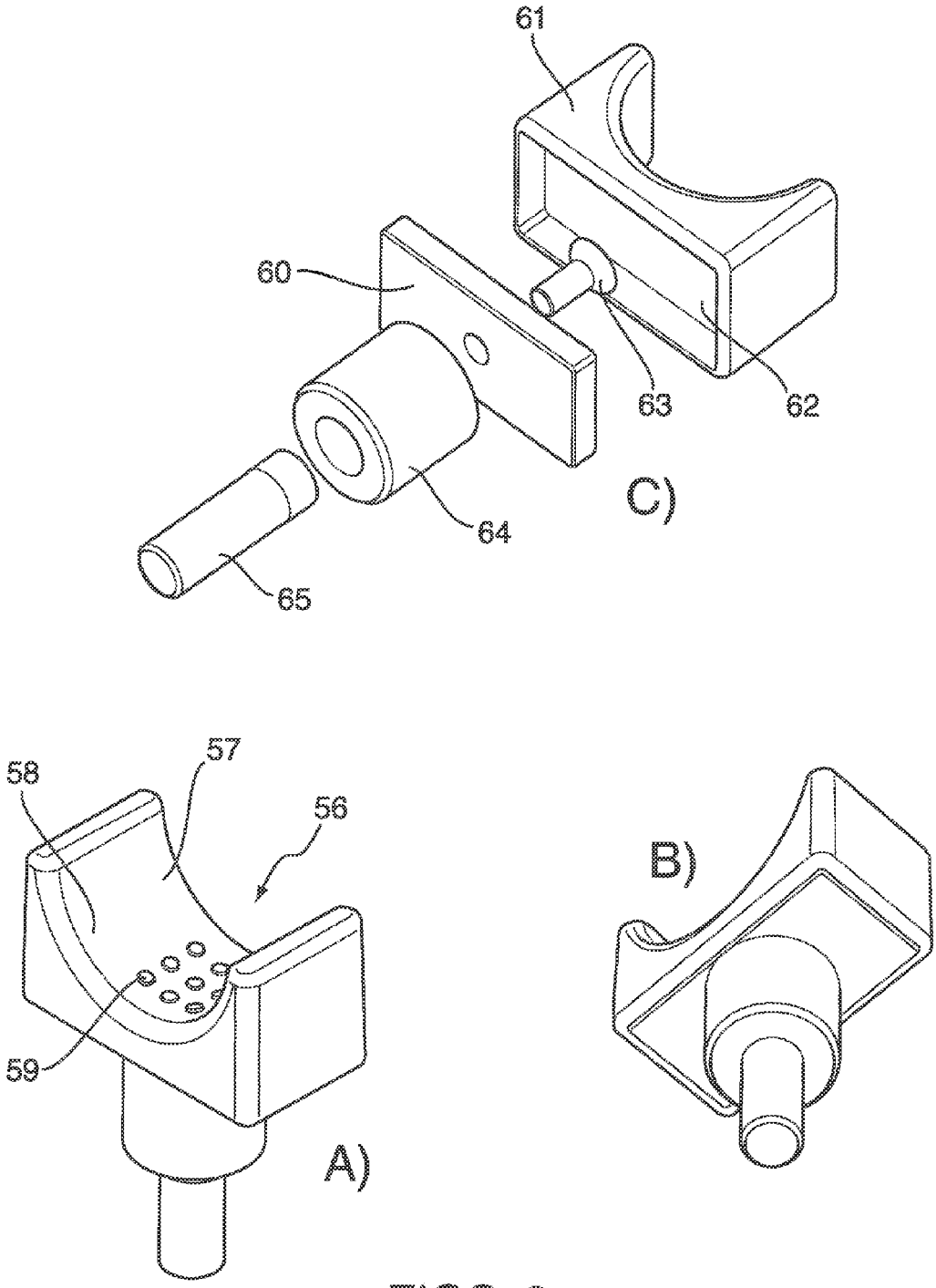
FIG. 9A shows a perspective view of a further embodiment of a pressure plate from the top.
FIG. 9B shows a perspective view of a pressure plate from beneath.
FIG. 9C shows an exploded perspective view.

FIGS. 8 and 9 provide further detail of the embodiments of FIGS. 7A and 7B. FIG. 8A shows a pressure plate 49 with a front concave surface 50. An array of pimples 51 projects from the surface 50. The array is placed primarily about the middle portion of the pressure plate rather than extending across its entire width. Extending rearward from the pressure plate, a boss 52 is provided. As shown in FIG. 8C, boss 52 is secured onto bar 53 by a fastener 54. Bar 53 is covered by a moulding 54 which may be elastomeric. A stud 55 may be employed to secure boss 52 to the load cell (not shown in the Figure).

FIG. 9 shows a pressure plate arrangement 56 with a circular recessed portion 57 with a forward-most surface 58. Surface 58 exhibits an array of pimples 59. The pressure plate is formed from a flat bar 60 over which is secured an elastomeric moulding 61. The elastomeric moulding incorporates a rear recess 62 in order to allow plate 60 to be tightly secured. A screw 63 fastens plate 60 on to boss 64. Stud 65 is provided to join boss 64 to a load cell.

Figure 10:
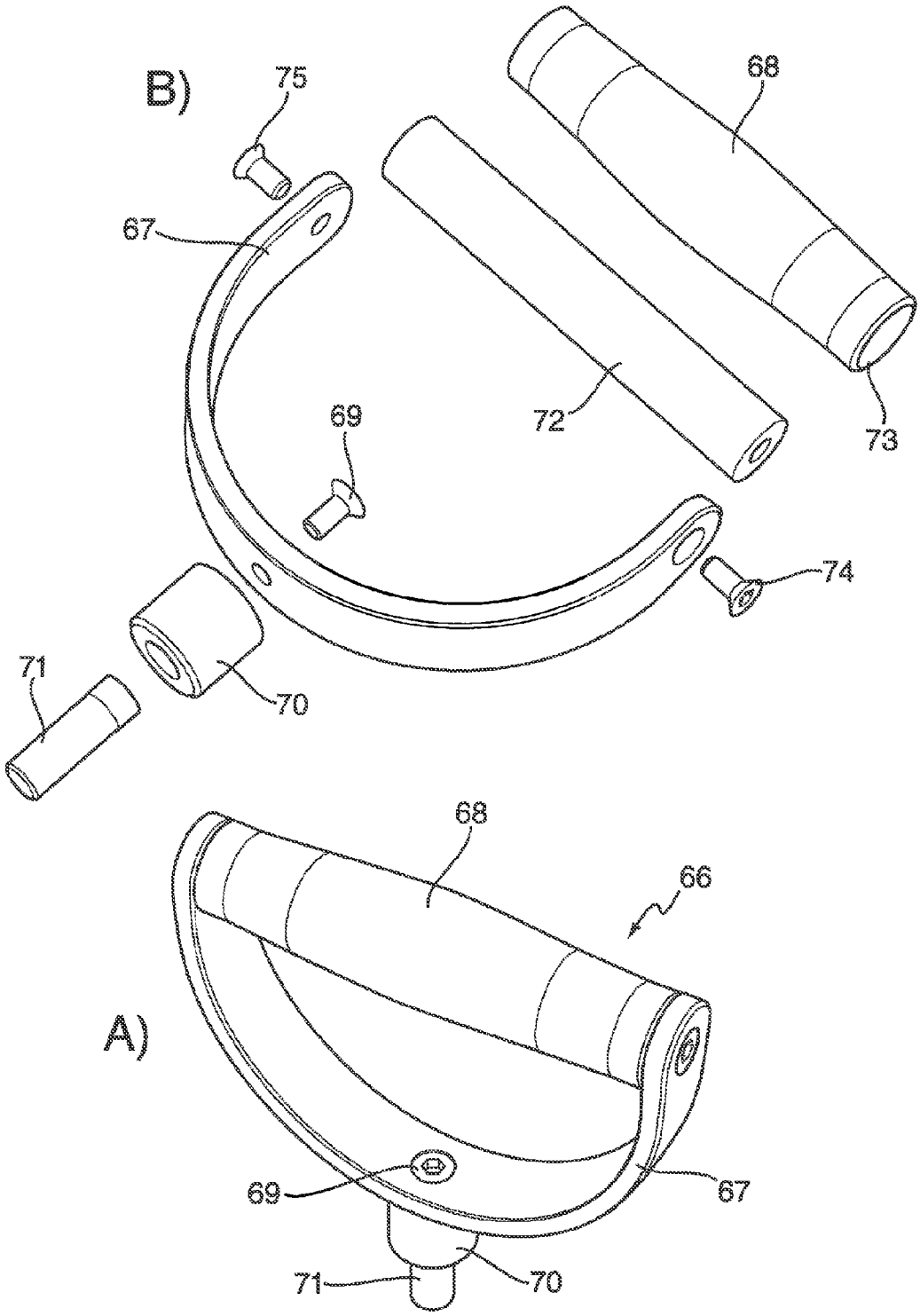
FIG. 10A shows a perspective view of a handle.
FIG. 10B shows an exploded perspective view of a handle.

FIG. 10A shows a handle 66 formed by a C-shaped plate 67 and an axle 68. A fastener 69 secures boss 70 onto the distal side of the plate 67. Boss 70 is in turn secured to stud 71 for attachment to the load cell. Axle 68 is formed by an outside cover 73, which may be of elastomeric material in order to be placed over a solid bar 72. The bar is secured at opposite ends to the C-shaped plate by fasteners 74 and 75.

As previously described, the load cell and/or the load bearing component of the apparatus may be equipped with a position sensor. This would allow the direction of the loading to be optimised. For example, in the context of the compression apparatus of FIGS. 7-10 this would for example allow compression to be applied at right angles to the body member against which the pressure plates are located. Similarly, it would allow the harness as the load bearing component in preceding embodiments to be applied at the prescribed angle in addition to the load being applied at a predetermined level.

The invention claimed is:

1. A muscle conditioning and muscle assessment apparatus comprising a load bearing component incorporating a proximal portion for engagement with at least part of a user's body, and a distal portion for securing said component to one of a force applying apparatus and an operator; and a transducer located between said proximal and distal portions; said transducer being configured to derive signals representative of at least one of the tensile and compression forces applied to said load bearing component; wherein said apparatus further comprises a sensor for determining at least one characteristic of position and displacement of said load bearing component; said apparatus being configured to output signals representative of said force and the direction of said force; wherein said load bearing component incorporates a harness for attachment to at least part of a user's body, said harness incorporating at least one strap for securing said harness to said at least part of a user's body; a distal portion for facilitating the attachment of said harness to one of a force applying apparatus and an operator; at least one joining member extending between said harness and said distal portion; and wherein said harness incorporates a first portion projecting, in use, from a first side of said body part and a second portion projecting, in use, from a second side of said body part; joining members being provided between said first portion and said distal portion; and between said second portion and said distal portion; and means for equalizing tensioning forces applied on said first and second portions.

2. An apparatus according to claim 1, wherein said transducer is part of a load cell equipped with a releasable fastener for releasably attaching said load cell to said one joining members.

3. An apparatus according to claim 1, further comprising a wireless transmitter for transmitting signals to a wireless receiver located remotely from said transmitter.

4. An apparatus according to claim 1, further comprising a housing containing said transducer; said housing being part metallic and part polymeric; said polymeric portion being in the form of a window through which wireless communication signals are transmitted.

5. An apparatus according to claim 1, further comprising a 3 dimensional position sensor which determines the position of said component.

6. An apparatus according to claim 1, further comprising a gyroscope for determining at least one characteristic of position and displacement of said component.

7. An apparatus according to claim 1, wherein said means for equalizing tensioning forces incorporate a pulley.

8. An apparatus according to claim 1, wherein said distal portion incorporates a handle.

9. An apparatus according to claim 8, wherein said transducer is provided between said handle and said means for equalising tensioning forces.

10. A system for muscle assessment and conditioning comprising:

a muscle conditioning and muscle assessment apparatus comprising a load bearing component incorporating a proximal portion for engagement with at least part of a user's body, and a distal portion for securing said component to one of a force applying apparatus and an operator; and a transducer located between said proximal and distal portions; said transducer being configured derive signals representative of at least one of the tensile and compression forces applied to said load bearing component; wherein said apparatus further comprises a sensor for determining at least one characteristic of position and displacement of said load bearing component; said apparatus being configured to output signals representative of said force and the direction of said force; and a processor and a display unit located remotely from said transducer for displaying the variation over time of the measured load for a given type of muscular motion of at least one particular muscle.

11. A system according to claim 10, wherein said apparatus is one of configured to and employed to steadily increase the applied load up to a maximum of the at least one particular muscle.

12. A system according to claim 10, wherein said processor is configured to determine the motion for which characteristics are being measured; said motions being selected from the group comprising: flexion, extension, adduction, abduction, protraction, retraction, and rotation.

13. A system according to claim 10, wherein said processor is configured to determine the direction of the motion; said motions being selected from the group comprising: right, left, forwards, backwards, upwards and downwards.

14. A system according to claim 10, wherein said processor is configured to determine a value representative of the deficit between maximum flexion and a corresponding maximum extension for said at least one particular muscle.

15. A system according to claim 10, wherein said processor and said display unit are configured to display a template comprising a plurality of sections; each section specifying a motion type and having a predetermined load characteristic for a predetermined time.

16. A system according to claim 10, wherein said processor and display unit are configured to display the measured load characteristic; said measured load characteristic being displayed over said template.

17. A muscle conditioning and muscle assessment apparatus, comprising a load bearing component incorporating a proximal portion for engagement with at least part of a user's body, and a distal portion for securing said component to one of a force applying apparatus and an operator; and a transducer located between said proximal and distal portions; said transducer being configured to derive signals representative of at least one of the tensile and compression forces applied to said load bearing component; wherein said apparatus further comprises a sensor for determining at least one characteristic of position and displacement of said load bearing component; said apparatus being configured to output signals representative of said force and the direction of said force; wherein said apparatus further comprises a processor and a display unit for displaying the variation over time of the measured load for a given motion of a particular muscle; said processor and said display being configured to display a template comprising a succession of distinct sections; each section specifying a motion type and having a predetermined load characteristic for a predetermined time.

18. An apparatus according to claim 17, wherein said processor and display unit are configured to display the measured load characteristic; said measured load characteristic being displayed over said template.

19. An apparatus according to claim 17, wherein said template incorporates distinct sections corresponding to distinct motion types selected from the group comprising: hold; hold left, hold right, rotate, hit central, sweep left, and sweep right.

* * * * *